US006201290B1

(12) United States Patent
Yamada et al.

(10) Patent No.: US 6,201,290 B1
(45) Date of Patent: Mar. 13, 2001

(54) RESISTOR HAVING MOISTURE RESISTANT LAYER

(75) Inventors: Hiroyuki Yamada; Mitsunari Nakatani, both of Fukui (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/228,025

(22) Filed: Jan. 8, 1999

(30) Foreign Application Priority Data

Jan. 8, 1998 (JP) ..... 10-002003

(51) Int. Cl.[7] ..... H01C 27/02

(52) U.S. Cl. ..... 257/536; 257/358; 257/359; 257/363; 257/489

(58) Field of Search ..... 257/358, 359, 257/363, 489

(56) References Cited

U.S. PATENT DOCUMENTS

| | | | | |
|---|---|---|---|---|
| 3,971,061 | * | 7/1976 | Matsushita et al. | 257/489 |
| 4,893,157 | * | 1/1990 | Miyazawa et al. | 257/358 |
| 5,554,873 | * | 9/1996 | Erdeljac et al. | 257/359 |

* cited by examiner

*Primary Examiner*—Fetsum Abraham
(74) *Attorney, Agent, or Firm*—Ratner & Prestia

(57) ABSTRACT

A resistor comprising a substrate typically made of aluminum, a pair of top electrode layers made of a thin noble metal film disposed on both ends of the top face of the substrate, and a resistance layer of a thin metal film made of Ni system or Cr system disposed on the top face of the substrate so as to electrically connect with the top electrode layer. The moisture absorbency of a protective layer is reduced to upgrade sealing of the resistance layer by covering the resistance layer with two resin layers: a first protective layer made of polyimide resin and a second protective layer made of epoxy resin, which have different water vapor permeability, to improve the reliability, particularly the moisture resistance characteristics, of the resistor.

6 Claims, 4 Drawing Sheets

RESISTOR HAVING MOISTURE RESISTANT LAYER

FIELD OF THE INVENTION

The present invention relates to the field of resistors; more particularly, to rectangular chip resistors and their manufacturing method.

BACKGROUND OF THE INVENTION

There is an increasing demand for rectangular chip resistors with highly accurate resistance to eliminate adjustment for circuits, as the size of electronic equipment continues to shrink in recent years. In particular, since the allowance required for the resistance of rectangular chip resistors is ±0.1% to ±0.5%, the demand for rectangular chip resistors made of thin metal film resistance material (hereafter referred to as "thin film rectangular chip resistors"), in which precise resistance can be easily achieved, is overtaking demand for conventional rectangular chip resistors, which are constituted of thick film resistance (hereafter referred to as "thick film rectangular chip resistors") made in grazed material.

On the other hand, as the use environment of electronic equipment diversifies, the required specification levels for rectangular chip resistors, which are electronic components, is also becoming higher. As the market for thin film rectangular chip resistors expands, reliability equivalent to that of thick film rectangular chip resistors, which have stable moisture resistance characteristics, is required.

A resistor and its manufacturing method of the prior art are explained below with reference to a drawing.

As shown in FIG. 4, a resistance layer 2 made of a thin metal film of Ni or Cr systems is disposed on the top face of a substrate 1 made typically of 96% aluminum. A pair of top electrode layers 3 made of a thin metal film such as Cu etc. are disposed on the left and right ends of the top face of the substrate 1 so as to overlap the resistance layer 2. A pair of bottom electrode layers 4 made of a thin metal film such as Cu etc. are disposed on both ends of the bottom face of the substrate 1, at positions corresponding to the top electrode layers 3. A protective layer 5 typically made of polyimide resin is provided on the top face of the resistance layer 2 to cover at least an exposed area of the resistance layer 2. In addition, a side electrode layer 6 made of a thin metal film such as Ni etc. is disposed on side faces of the substrate 1 so as to connect the top electrode layer 3 and the bottom electrode layer 4. Lastly, a Ni plating layer 7 is provided to cover the top electrode layer 3, bottom electrode layer 4, and side electrode layer 6. A solder plating layer 8 is provided to cover the Ni layer 7 to form a complete resistor.

A method for manufacturing the resistor as configured above is explained next with reference to a drawing.

FIG. 5 is a process chart showing a method for manufacturing the resistor of the prior art. A substrate 11 is a heat-resisting substrate made typically of 96% aluminum (Process A). A thin film resistance layer, typically of NiCr etc. is provided on the entire face of the substrate 11 by sputtering (Process B). A resistance pattern 12 is formed by photo-etching this thin film resistance layer (Process C).

Next. a thin film top electrode layer such as Ni etc. is sputtered on the entire face of the substrate 11 where the resistance pattern 12 is formed (Process D), and a top electrode pattern 13 is formed by photo-etching this thin-film top electrode layer (Process E). Then, heat treatment at 350° C. to 400° C. is applied in a nitrogen gas ambient to stabilize the films of the resistance pattern 12 and the top electrode pattern 13 (Process F).

Next, laser trimming is applied to adjust the resistance of the resistance pattern 12 to a specified value (Process G). A protective layer 15 made of thermosetting resin such as polyimide resin is provided to protect the resistance 14 after the resistance is adjusted (Process H).

Next, a groove 16 for dividing the substrate 11 is made by scribing with carbon oxide gas laser (Process I), and the substrate 11 is primarily divided to substrate strips 17 (Process J). A side electrode layer 18 is formed on a side face of these substrate strips 17 by means such as sputtering (Process K).

After secondary division of the substrate strips 17 into substrate pieces 19 (Process L), an electrode plating layer 20 is finally formed to secure reliability of soldering (Process M), resulting in manufacture of the resistor of the prior art.

The resistor and its manufacturing method of the prior art, however, use thermosetting resin such as polyimide resin for the protective layer of thin film rectangular chip resistors. This has far greater water vapor permeability, due to its material characteristics, comparing with inorganic materials such as the borosilicate lead glass used as the protective layer for thick film rectangular chip resistors. Accordingly, water molecules are likely to penetrate the resistance layer through the protective layer if the resistor is exposed to a high ambient humidity. This will cause changes in resistance value due to oxidization of the resistance layer. Furthermore, electro-corrosion may cause disconnection if ions with high corrosivity such as $Na^+$, $K^+$, and $Cl^-$ are present.

SUMMARY OF THE INVENTION

The present invention reduces the moisture absorbency of the protective layer, improving the resistor's moisture resistance.

The present invention relates to a resistor comprising a substrate, a pair of top electrode layers disposed on both ends of the top face of the substrate, a resistance layer disposed on the top face of the substrate so as to electrically connect with the top electrode layer, a first protective layer made of resin disposed on the top face of the substrate to cover at least the exposed area of the resistance layer, and a second protective layer made of resin disposed to cover at least the first protective layer: and its manufacturing method. More specifically, the moisture absorbency of the protective layer is reduced by covering the resistance layer with two layers: the first and second resin protective layers, which have different characteristics, to improve the reliability, particularly the moisture resistance characteristics, of the resistor.

DESCRIPTION OF PREFERRED EMBODIMENT

A resistor and its manufacturing method in accordance with a preferred embodiment of the present invention are explained with reference to drawings.

Figure 1:
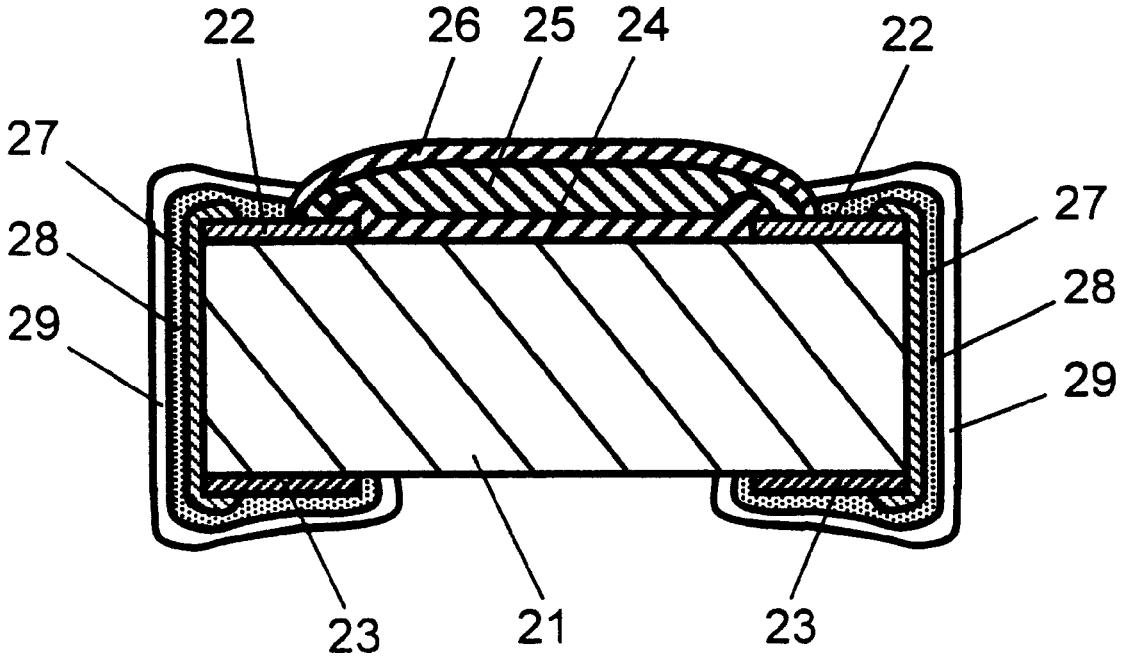
FIG. 1 is a section view illustrating configuration of a resistor in accordance with a preferred embodiment of the present invention.

In FIG. 1, a pair of top electrode layers 22 of a thin metal film made of a noble metal such as Au and Ag are disposed on both ends of the top face of an insulated substrate 21 made of 96% aluminum. Similarly, a pair of bottom electrode layers 23 of a thin metal film made of a noble metal are disposed oil the bottom face of the substrate 21 at positions facing the top electrode layers 22 through the substrate 21.

A resistance layer 24 of a thin metal film made of Ni system or Cr system such as Ni—Cr and Cr—Si is disposed on the top face of the substrate 21 so as to electrically connect with the top electrode layer 22. A first protective layer 25 made typically of polyimide resin is disposed on the top face of the substrate 21 covering at least the exposed area of the resistance layer 24. In addition, a second protective layer 26 made typically of epoxy resin is disposed to cover at least the first protective layer 25. Then, a side electrode layer 27 of a thin metal film made typically of Ni alloy or Cr alloy is disposed on a side face of the substrate 21 so as to electrically connect the top electrode layer 22 with the bottom electrode layer 23. A Ni plating layer 28 is then disposed to cover the top electrode layer 22, bottom electrode layer 23, and side electrode layer 27. Lastly, a solder layer 29 is further disposed to cover the Ni layer 28.

The water vapor permeability of the polyimide resin used for the first protective layer 25 is approximately $3.5\times10^{-4}$ ($\mu$g/sec·cm$^3$) in an ambient atmosphere of 60° C. and 95% humidity. The water vapor permeability of the epoxy resin used for the second protective layer 26 is approximately $1.5\times10^{-4}$ ($\mu$g/sec·cm$^3$) under the same ambient conditions. The second protective layer 26 clearly has a smaller water vapor permeability than the first protective layer 25.

Next, a method for manufacturing the resistor of the preferred embodiment as configured above is explained with reference to a drawing.

Figure 2:
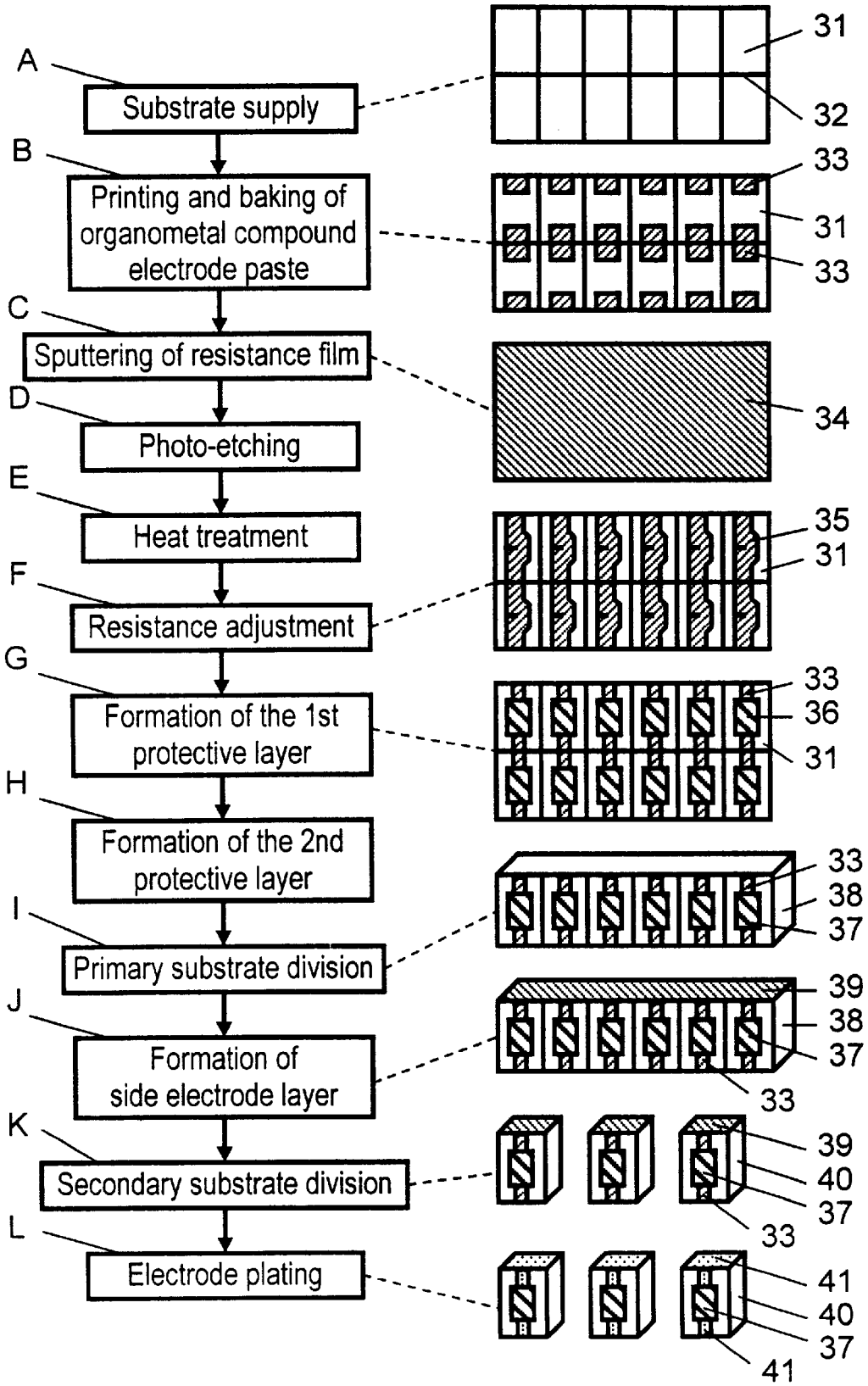
FIG. 2 is a process flow chart illustrating a method for manufacturing the resistor in accordance with the preferred embodiment of the present invention.

As shown in FIG. 2, a substrate 31 made of 96% aluminum with good heat resistance and insulation whose surface is vertically and horizontally divided by division grooves 32 is supplied (Process A).

A conductive organometal compound paste containing noble metals such as Au and Ag as conductive powder is applied by screen printing to both ends of the top face of the substrate 31. The substrate 31 is then fired in a conveyor-type curing furnace for approximately 5 minutes at approximately 850° C. to firmly adhere the conductive paste to the substrate 31 and create a top electrode layer 33 in the form of a thin metal film (Process B).

A conductive organometal compound paste containing noble metals such as Au as a conductive powder is applied by screen printing to the bottom face of the substrate 31 at a position facing the top electrode layer 33 through the substrate 31. The substrate 31 is fired in a conveyor-type curing furnace for approximately 5 minutes at approximately 850° C. to firmly adhere the conductive paste to the substrate 31 and create a bottom electrode layer (not illustrated).

A thin film resistance layer 34 is formed over the entire face of the substrate 31, on which the top electrode layer 33 is disposed, by sputtering, using Ni alloy or Cr alloy as the target (Process C).

After the thin film resistance layer 34 is photo-etched into a resistance 35 to form a specified shape (Process D), heat treatment is applied to the resistance 35 in air at 270° C. to 400° C. to create a stable film of the resistance 35 (Process E).

The resistance 35 is trimmed using a YAG laser to adjust it to a specified resistance (Process F).

Then, a resin paste such as polyimide resin is applied by screen printing to the resistance 35 to protect the resistance 35, and the resin paste is baked in a conveyor-type curing furnace for approximately 30 minutes at approximately 350° C. to firmly adhere the resin paste to the substrate 31 and form a first protective layer 36 with a film thickness of 20 $\mu$m (Process G).

A resin paste such as epoxy resin is applied by screen printing to cover the first protective layer 36, and the resin paste is baked in a conveyor-type curing furnace for approximately 30 minutes at approximately 200° C. to firmly adhere the resin paste to the substrate 31 and form the second protective layer 37 with a film thickness of 20 $\mu$m (Process H).

Next, the substrate 31 is horizontally divided along the division groove 32 into a substrate strip 38 so as to expose the side face of the substrate 31 (Process I).

Ni alloy or Cr alloy is sputtered on the two longer side faces of the substrate strip 38 to form a side electrode layer 39 consisting of a thin metal film so as to electrically connect the top electrode layer 33 with the bottom electrode layer (Process J).

The substrate strip 38 is then vertically divided along the division groove 32 into a substrate piece 40 (Process K).

The surfaces of the top electrode layer 33, bottom electrode layer, and side electrode layer 39 are plated with nickel (not illustrated) to prevent electrode eating by solder (electrode dissolving in solder) and to secure soldering reliability. Then a solder layer 41 is disposed over the nickel layer (Process L), resulting in manufacture of the resistor in the preferred embodiment of the present invention.

Moisture resistance life test (Test conditions: temperature: 60° C., humidity: 95%, test duration: 1,000 hours, and application of rated voltage in a cycle of ON for 1.5 hr and OFF for 0.5 hr) and PCBT (Pressure Cooker Bias Test, test conditions: Temperature: 121° C., 2 atmospheric pressures, humidity: 100%, test duration: 200 hours, and application of 1/10 rated voltage in a cycle of ON for 1.5 hr and OFF for 0.5 hr) were conducted as evaluation tests for comparing the resistor in accordance with the preferred embodiment of the present invention and a resistor of the prior art.

Figure 3:
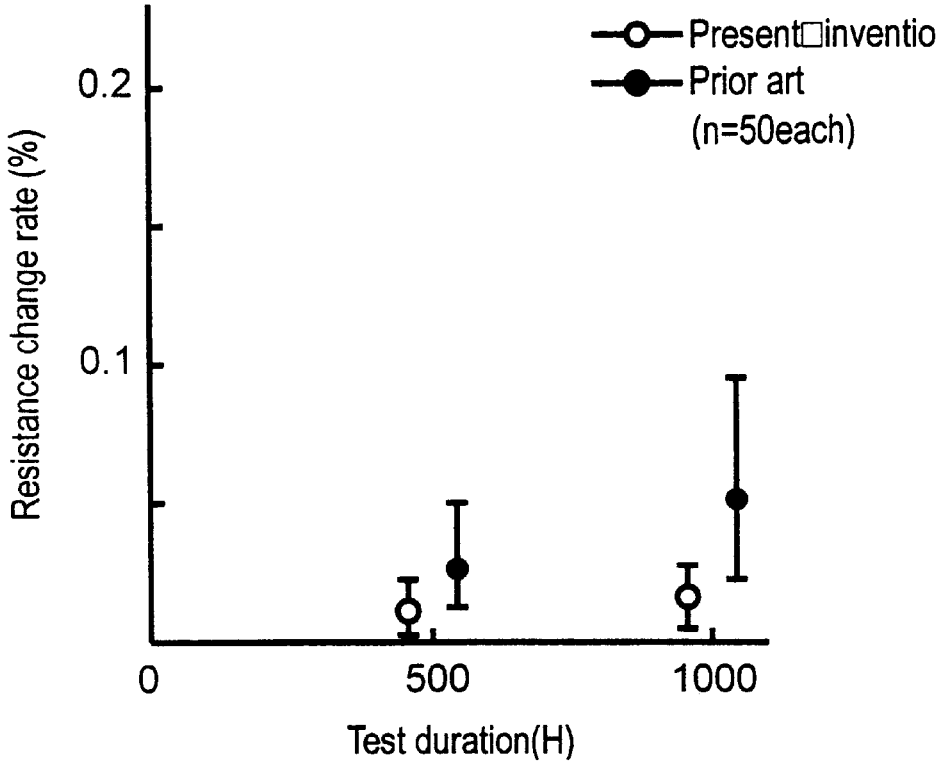
FIG. 3 shows characteristics comparing results of the moisture resistance life test between the resistor in accordance with the preferred s embodiment of the present invention and a resistor of the prior art.
Figure 4:
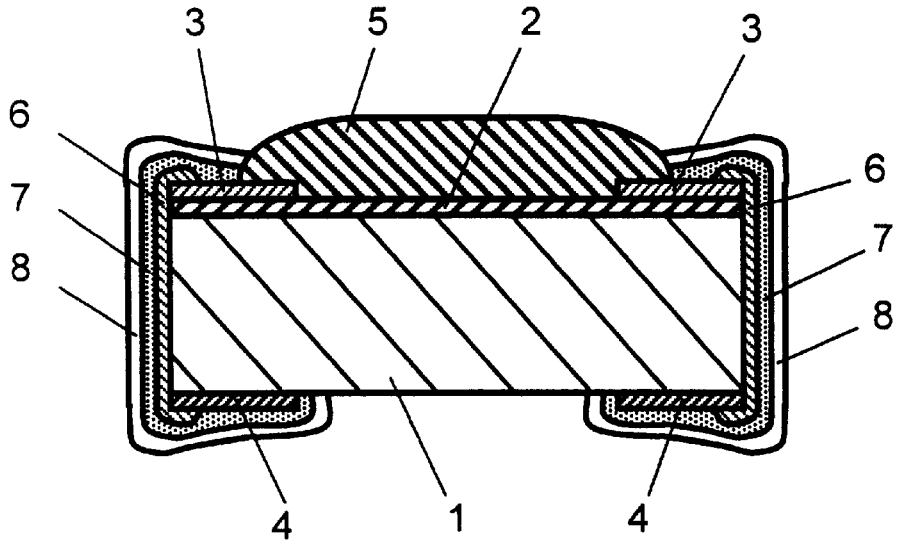
FIG. 4 PRIOR ART
FIG. 4 is a section view illustrating configuration of the resistor of the prior art.
Figure 5:
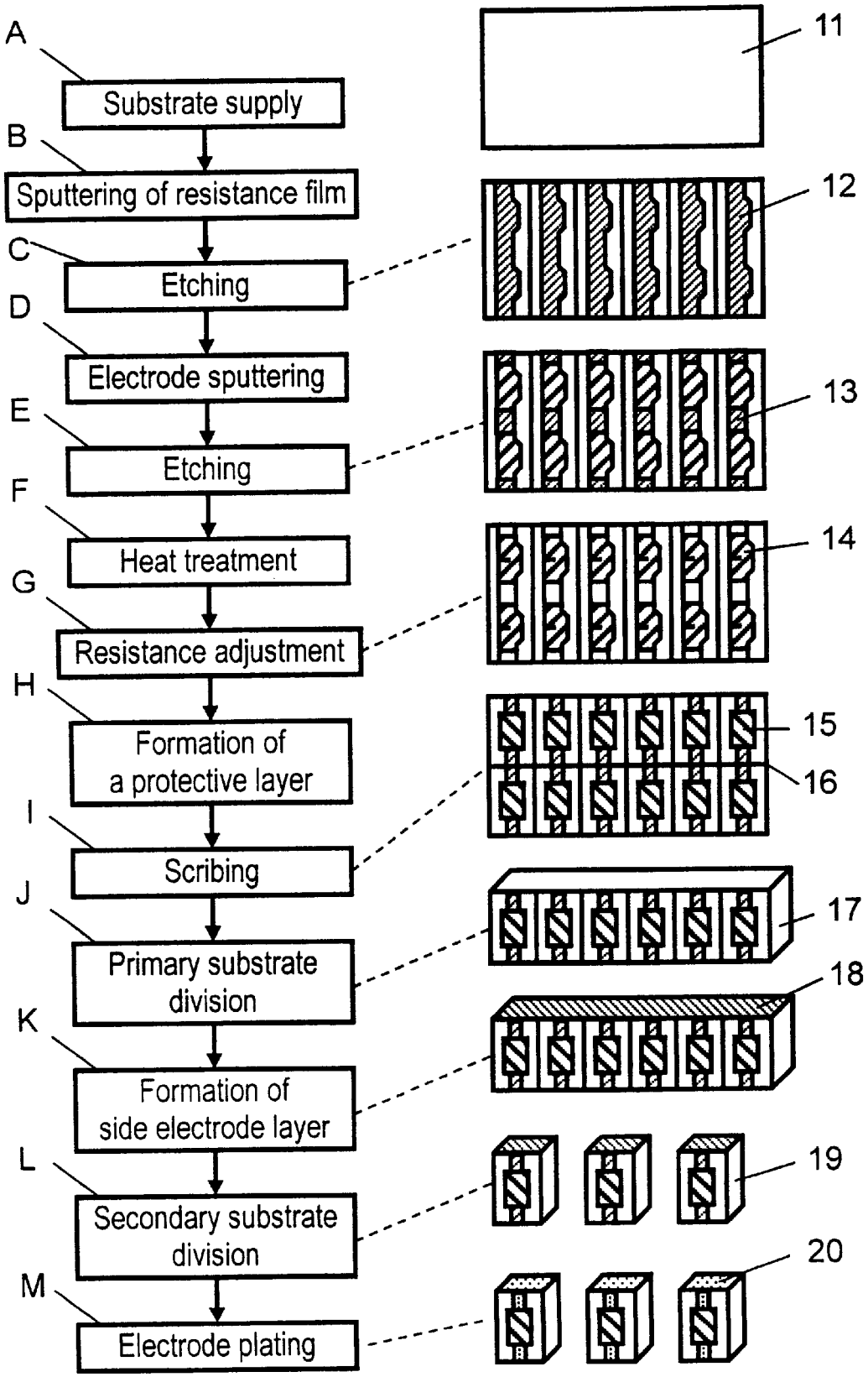
FIG. 5 PRIOR ART
FIG. 5 is a process flow chart illustrating a method for manufacturing the resistor of the prior art.

FIG. 3 shows the moisture resistance life characteristics illustrating the relation between the test duration and resistance change rate of the resistor cf the prior art and the resistor of the preferred embodiment. It is apparent from FIG. 3 that the resistor of the preferred embodiment has better moisture resistance. the PCBT, disconnection defects occurred in three of twenty resistors of the prior art, but none of the resistors of the present invention.

Accordingly, the preferred embodiment of the present invention enables the manufacture of a resistor with good moisture resistance which reduces moisture reaching the resistance layer 24 by covering the resistance layer 24 of a thin metal film with a first protective layer 25 made of polyimide resin and further covering the first protective layer 25 with the second protective layer 26 made of epoxy resin which has lower water vapor permeability than the first protective layer 25.

Under test conditions such as of PCBT, the water vapor permeability of polyimide resin and epoxy resin are reversed due to the characteristics of resin materials. In this case, the first protective layer 25, which becomes to have smaller water vapor permeability, prevents the entry of moisture, further improving the resistance characteristics.

In a preferred embodiment of the present invention, the first protective layer 25 is made of polyimide resin and the second protective layer 26 is made of epoxy resin. However, both first and second protective layers may be made of epoxy resin.

In a preferred embodiment of the present invention, the resistance layer 24 comprises a Ni system thin metal film such as Ni—Cr. The same effect is achievable by configuring a thin metal film of either a Cr system such as Cr—Si and Cr—Al, or of a Ta system such as TaN.

In a preferred embodiment of the present invention, the top electrode layer 22 is also made of a thin metal film of a noble metal such as Au and Ag. The same effect is also achievable by making a thin metal film with using Ni system such as Ni and Ni—Cr, or a Cu system such as Cu and Cu alloy.

In a preferred embodiment of the present invention, a method for manufacturing the resistor is explained with reference to the substrate 31 with division grooves 32. This does not intend to limit the manufacturing method of the resistance layer 24. The same effect is also achievable by forming the resistance layer by applying the manufacturing method used for the resistor of the prior art.

Furthermore, moisture resistance is improved with increasing thickness of the first and second protective layers 25 and 26. However, the increase in moisture resistance levels off at approximately 20 $\mu$m or thicker. Although upgrading the moisture resistance is limited by thickening the film if the same material is used for the protective layers, it can be drastically improved by laminating resin materials with different characteristics to compensate additively for the individual characteristics of each resin material.

Accordingly, the same effect is achievable by providing three or more protective layers, although the preferred embodiment of the present invention utilizes only two resin layers.

The present invention as explained above in the preferred embodiment thus reduces the moisture absorbency of the protective layer by covering the resistance layer of a thin metal film with first and second protective layers comprising different resin materials, resulting in improved reliability of the resistor, particularly its moisture resistance characteristic. Adhesion of the protective layer to the substrate and the sealing capability of the resistance layer are improved by the use of epoxy resin, which has high adhesivity to the aluminum substrate, for the second protective layer.

What is claimed is:

1. A resistor comprising:

a substrate having a top face;

a pair of top electrode layers disposed on sides of the top face of said substrate;

a resistance layer disposed on the top face of said substrate so as to electrically connect with said top electrode layers;

a first resin protective layer disposed to cover at least an exposed area of said resistance layer on the top face of said substrate; and a second resin protective layer disposed to cover at least said first protective layer wherein said first protective layer has a first water vapor permeability which is greater than a second water vapor permeability of said second protective layer.

2. The resistor as defined in claim 1, wherein said first protective layer comprises a polyimide resin and said second protective layer comprises an epoxy resin.

3. The resistor as defined in claim 1, wherein said first protective layer and said second protective layer are both comprised of epoxy resin.

4. The resistor as defined in claim 1, wherein said resistance layer is a thin metal film comprising at least one of Ni, Cr, and Ta.

5. The resistor as defined in claim 1, wherein said top electrode layers are thin metal films comprising at least one of Ni, Au, and Cu.

6. A resistor comprising:

a substrate having a top face;

a pair of top electrode layers disposed on sides of the top face of said substrate;

a resistance layer disposed on the top face of said substrate so as to electrically connect with said top electrode layers;

a first resin protective layer disposed to cover at least an exposed area of said resistance layer on the top face of said substrate; and a second resin protective layer disposed to cover at least said first protective layer, wherein said first protective layer comprises a polyimide resin and said second protective layer comprises an epoxy resin.

* * * * *